US005522623A

United States Patent [19]

Soules et al.

[11] Patent Number: 5,522,623

[45] Date of Patent: Jun. 4, 1996

[54] CODED IDENTIFICATION CARD AND OTHER STANDARDIZED DOCUMENTS

[75] Inventors: Jack A. Soules, Shaker Heights; Bryan D. Carpenter, Cleveland, both of Ohio

[73] Assignee: Technical Systems Corp., Cleveland, Ohio

[21] Appl. No.: 477,191

[22] Filed: Jun. 7, 1995

Related U.S. Application Data

[63] Continuation-in-part of Ser. No. 149,325, Nov. 9, 1993, which is a continuation-in-part of Ser. No. 983,973, Dec. 1, 1992, Pat. No. 5,259,907, which is a division of Ser. No. 501,148, Mar. 29, 1990, Pat. No. 5,067,713.

[51] Int. Cl.[6] ..... B42D 15/00

[52] U.S. Cl. ..... 283/91; 283/88

[58] Field of Search ..... 283/72, 82, 83, 283/84, 85, 88, 89, 91, 92, 113, 901

[56] References Cited

U.S. PATENT DOCUMENTS

| | | | |
|---|---|---|---|
| 4,591,707 | 5/1986 | Stenzel et al. | 283/91 X |
| 4,663,518 | 5/1987 | Borror et al. | 283/91 X |
| 4,889,367 | 12/1989 | Miller | 283/88 |
| 5,169,155 | 12/1992 | Soules et al. | 283/88 X |
| 5,176,405 | 1/1993 | Kaule et al. | 283/91 X |
| 5,259,907 | 11/1993 | Soules et al. | 283/88 X |

*Primary Examiner*—Willmon Fridie, Jr.
*Attorney, Agent, or Firm*—Alfred D. Lobo

[57] ABSTRACT

An apparently conventional document such as an identification (ID) card is constructed as a laminate within which is a code or other coding indicia such as a photograph, bar code or fingerprint. concealed from human view. The document is read by a conventional electro-optic reader means placed against a face of the card, if the reader uses a beam of light in the wavelength absorbed by the material with which the coded indicia is produced, but reflected by the background against which the coded indicia is "seen" by the beam. The card is preferably a laminate of at least an upper lamina and a lower lamina, each made of a synthetic resin which has a substantially white imprintable surface conventionally printed with the identification of the owner of the card with a pigment-free, non-aqueous ink which is visible to the human eye but substantially transparent to wavelengths outside the visible range. Typically, both the upper and lower laminae, are opaque to visible light, but the face through which the coded indicia is to be read by the reader, is transparent to the reader's beam. The code is read because there is sufficient contrast between the transmitted and absorbed light in the wavelength used by the reader.

9 Claims, 1 Drawing Sheet

CODED IDENTIFICATION CARD AND OTHER STANDARDIZED DOCUMENTS

BACKGROUND OF THE INVENTION

This application is a continuation-in-part application of Ser. No. 08/149,325 filed Nov. 9, 1993, which is a continuation-in-part application of Ser. No. 07/983,973, filed Dec. 1, 1992 issued as U.S. Pat. No. 5,259,907, which in turn is a divisional of Ser. No. 07/501,148 filed Mar. 29, 1990 issued as U.S. Pat. No. 5,067,713 on Nov. 26, 1991.

This invention relates to an internally coded laminated standardized document such as an identification card, label or other document unrelated to any card game, and of no value in playing a game with cards. The playing card of the parent case, though conceptually related, is physically distinguished in that a playing card is necessarily printed in different colors, and each color had to be formulated from a different combination of inks, all of which inks, in turn, were formulated from water-based dyestuffs. We did not know, at the time the '155 patent issued, how to formulate a non-aqueous ink which was permeable to either infra-red (IR) or ultraviolet (UV) light, and it is only such inks which are used in standardized documents of this invention.

In the '155 patent we stated that only the intermediate layer (or lamina) of the laminated card carried the code printed on it, the code being printed with an ink which was either IR- or UV-absorptive, or both (that is, the ink absorbed both wave lengths, and generally, also the visible). Since the intermediate layer was covered by the upper lamina through which the IR or UV wavelength was to pass unabsorbed, it was essential that the inks used to print the colors of the indiciae on the cards be substantially transparent to the wavelength used to read the code on the intermediate layer hidden by the upper lamina. By "substantially transparent" is meant that the upper lamina is permeable to the chosen human-invisible wavelength to the extent necessary to read the code, typically in excess of about 80% of the incident radiation passes through. The water-based inks used to print playing cards were unsuitable for printing other documents which demanded the use of a non-aqueous ink. By "non-aqueous ink" we refer to an ink which is free of pigments, and formulated with dyestuffs dispersed or dissolved in a non-aqueous liquid. A dyestuff may be used, such as one developed on paper or other substrate, to make a photograph; or, a photographic likeness is printed with closely spaced dots of non-aqueous ink. Whether, ink or dyestuff, the printing medium used for the indiciae printed on the upper lamina of the coded document of this invention, is pigment-free and non-aqueous. We used such inks to print the code to be read on the intermediate layer because they were not transparent either to IR, or UV, or visible wavelengths.

Accordingly, under the patent statutes of this country, in the '155 patent we could only claim what we regarded to be our invention.

It is critical in the invention claimed herein that the overlay (upper lamina) be imprinted with a non-aqueous, pigment-free ink which provides the human-visible indiciae. Whether these indiciae cover a portion, or all, of the printed overlay, it is critical that the printed overlay be permeable to the human-invisible (not visible to the human eye) wavelength used to read the code, in both directions through the overlay. The criticality of this feature derives from the requirement that the intermediate layer reflects the light to be read, returning the human-invisible light in the same general direction in which it was beamed into the card.

Only the '155 patent teaches an ink which is permeable to IR or UV light but which absorbs and reflects in the visible region. There is no other suggestion of such an ink in the relevant prior art. In particular, following the teachings of the '155 patent, one printed a document, other than a playing card, with a water-based ink such as is used to print the face value of a playing card, the document would not be generally accepted in commerce, or in the marketplace. If the document was printed with a commercially available non-aqueous printing ink, such as is typically used to print identification cards and other documents, the code to be read could not have been printed directly beneath the printed upper lamina, with print overlapping the code.

A demonstration of how a hidden code on an intermediate lamina was read by a camera is provided in U.S. Pat. No. 4,222,662 to Kruegle. Kruegle laterally off-sets the human-visible image on his upper lamina so as to provide a blank space for an optical filter. He must do this because the TV camera in Kruegle cannot "see through" human-visible indiciae. Even if the camera could "see" with IR or UV wavelengths, it could not read the hidden image unless the human-visible indiciae were printed with IR- or UV-permeable inks. In the Kruegle disclosure, the photograph would have to be developed from dyestuffs which were permeable to the human-invisible light used by the camera. It is well known that such dyestuffs are generally not permeable to either IR or UV light. Further, an optical filter is necessary because a camera cannot tolerate "scatter" of wavelengths. There is no suggestion the camera can read the hidden code or image without an optical filter, and there is no suggestion that one use a scanner instead of a TV camera.

In the sole reference to printing on the optical filter Kruegle states "Further, to allay suspicion, the surface of filter region **13*b*** can be printed with some innocuous design or company logo which does not interfere with the intended purpose of the filter." But this is not an enabling disclosure because he fails to specify with what medium he would print his "innocuous design", whether with a photograph using generally available photographic dyestuffs, or with an ink. Clearly there is no indication that he used an ink, nor a suggestion that he knew of an ink to be used which is transparent to the IR or UV light the camera might have used.

Most inks which are highly absorbing in the visible range are not transparent to either ultraviolet or infrared wavelengths in a range one might commonly expect to use in a commercial device such as a TV camera or a scanner. For example, an ink which is highly absorbing in the visible range but transparent at 800 nm (nanometers) is an ink used in a Flair® brand felt tip pen.

By "identification card" we refer to any card or label which carries information as to the identity of the carrier of the card, e.g. an ID card for an employee of a company or for a student at a university, or a driver's license; a bank, or gasoline credit card; or, a label which identifies an article of arbitrary size and shape, such as packing cartons, or merchandise to which the card is attached. Labels are currently identified with human and machine readable indiciae as described for example in U.S. Pat. No. 4,889,367 to Miller, and in the references cited therein.

Other documents to which this invention is directed are larger cards, that is, larger than a conventional ID card which is typically about 5.5 cm×8.75 cm, such as a card which carries information about the codes for locks on an automobile, or identifications of various parts used in its construction; or, a card which carries information as to the model of a vehicle for sale, some of which information is meant to be hidden from the prospective purchaser, e.g. the actual price the seller has paid, the origin of the vehicle, the conditions under which it was purchased by the seller, etc.

Still other documents are certificates of registration, documents relating to insurance carried, to the blood type of an insured, medical history, executed original contract, wills, warranty deeds, bearer bonds, passports, etc., all of which may now be coded to contain information meant for only a particular party to whom that information is to be made available, and to no other party not equipped to read the coded information. For the sake of convenience and brevity any such standardized document coded as taught in this invention is generically referred to hereinafter as "document".

In each embodiment, no change is made to the information carried on the document's face, and the document appears to be identical to one which does not carry the human-invisible coded information. The coded information is stored in a unique pattern visible only in the infrared (IR) or ultraviolet (UV) regions, without being visibly defaced. The coded document is an otherwise conventional identification card formed from either a single non-laminated sheet of flexible material ("card stock"), such as paper, preferably coated with a cured latex of an acrylate-containing polymer; or, a laminate of printed card stock sandwiched between sheets of thin light permeable synthetic resinous material (plastic) coextensive with the card stock, and designed to protect the card as well as provide it with stiffness. Typically a document such as an ID card will have a photograph of the owner of the card adhesively secured to the card before it is laminated between the plastic sheets, as schematically illustrated in FIG. 1 herein.

The laminated document is coded in a reflective region between an upper lamina and a lower lamina, at least one of which, typically the upper, is opaque to the human eye but permeable to an IR or UV laser beam of predetermined wavelength. The reflective region lies in an intermediate zone between the upper and lower laminae, and the code to be read contrasts with the reflective region in a manner such that an electronic device can access whatever information the code may have been devised to reveal. Of course, in addition, the document conveys information which is visible to the human eye. The reflective region typically includes a surface which will reflect the IR or UV laser beam and is imprinted with letters or a picture ("indiciae") in inks which are permeable to the wavelength of light used to read the covered code or figure which absorbs that wavelength.

In a specific embodiment, the code indicates to an electronic "reader" the hidden fingerprint of the owner of the ID card, foiling the use of that card by someone who does not own that fingerprint. When the ID card is presented to a reader adapted to read both the fingerprint covered in the card, and a person's fingerprint, and the reader compares the fingerprints it reads against one another, the mismatch is discovered.

As one skilled in the art will readily appreciate, coding a document with a human-visible fingerprint, or a standard Hollerith pattern or "bar code", by which each document is uniquely identified, is a routine task. To code a document with the code being covered with an opaque sheet, whether that code is visible to the human eye or not, so that the document may be read by a machine viewing only the face of the ID card which traverses the reading means of a machine, is not a routine task. It is not a routine task even if all the information, both human-visible and machine-readable is carried on the surface of the document. The difficulty is increased in either case, because the document must be read without defacing it, and essentially without regard for its orientation in the plane in which the code is machine-read; that is, a lateral plane when the document traverses the reading means in that plane, and a vertical plane when the document traverses the reading means in the vertical plane.

Coded playing cards coded as disclosed in U.S. Pat. No. 4,534,562 to Cuff et al, were conventionally marked with a binary code along its opposite edges so that the code could be seen by the human eye (read by light in the range of visible wavelengths). Since there was no concern about hiding the fact that the cards were coded the necessity of overprinting the faces of the cards did not arise, and the cards were marked on the side edges.

In Miller '367, the surface of a package of corn chips provided the substrate which was marked with machine readable information overprinted on human-readable symbology, each with a different type of ink. It is essential that the machine-readable ink be essentially invisible to the human eye; that is, the human-readable ink absorbs energy in the visible but insufficient energy in another wavelength range to prevent a bar-code reading machine ("reader") from reading the bar code. However, because the two inks of the human-visible and machine readable information overlap, in practice the images printed in human-visible ink suffer from the dilution of the machine-readable ink. Since the degree of dilution is different in different areas of the field, depending upon the amount of interaction between the two inks, the inevitable result is an uneven appearance of the image on the surface.

Further, knowing how difficult it is to find infrared or ultraviolet-absorptive inks which do not absorb in the visible region, that is, have essentially no color, it must be accepted that it is even more difficult to find two inks which do not, when mixed, noticeably interfere with each other. Though inks having very specific energy absorption and reflection characteristics are commercially available, if only on special order, no suggestion or illustrative example of an infrared or ultraviolet absorbing ink which does not substantially absorb in the visible region, is provided in the '562 or '367 patents. Thus the "invisible" bar code of the '367 patent, in practice, is limited to use on colored substrates, such as a mustard color on a bag of chips, or the brown or blue of other snack foods.

Such a two-ink printing of a bar code on a substrate was well-suited for coding an article where its appearance is of relatively minor concern, for example, an inventory and shipping label on a carton. But the appearance of the document is of the utmost concern in a document such as an identification card which carries a photograph of a person.

Moreover, the Miller '367 coding overlapped with human-visible indiciae is printed in only one orientation. This allows a package to be read when passed across a grocery store counter where the laser reading the bar code rotates until it can read the code. However, since the orientation of the bar code is fixed on each of the foregoing substrates in the '367 and '562 patents, the code can only be read in one direction by a reader having a fixed light source.

Still further, there is no suggestion in the prior art as to what kind of contrast is required between the infrared "ink" and the background against which it is printed to enable the code to be read without being scattered by the human-visible ink.

Our coded document uses an essentially invisible bar code, typically only because the bar code is covered under the surface of the conventionally printed document. A "covered up" code which can be read only by an electro-optical reading means using light in the IR region is described in greater detail hereinbelow, though, in addition it may have a human-visible bar code as illustrated in FIG. 2 herein.

The unexpected result of being able to code only the "covered up" or hidden reflective region of a document essentially invisibly, is that the reflective surface may be imprinted, that is, marked or printed, textured or etched with the code either singly or repetitively and in multiple orientations, depending upon the figure to be read and recognized, thus enabling the document to be read in any generally lateral orientation whatsoever, as long as the document traverses, that is, passes over the machine which reads it, preferably in contact with it. Of course, the document may also be marked with the code in such a manner that the reader will read the code in any generally fixed direction (say along the horizontal x-axis), whether the document is introduced to the reader from either end along the axis.

For example, the particular advantage of coding the ubiquitous "plastic card" according to this invention, is that the code hidden within the card is essentially non-susceptible to wear because the code is covered with and protected by the upper and lower laminae which have specified optical properties, described in greater detail herebelow. The upper and lower laminae are self-supporting sheets of material which serve as the top and base layers, respectively, of the laminated card.

The term "lamina" is used to emphasize the fact that the sheet is self-supporting and of appreciable thickness, at least about 0.5 mil (0.0005 inch) thick. The terms "top layer" or "upper layer" and "base layer" or "lower layer" are used synonymously with "upper lamina" and "lower lamina" herein only because the former terms are less awkward and more familiar than the latter. The term "intermediate layer" or reflective surface refers either to a selectively reflective non-self-supporting layer typically less than about 0.5 mil thick, or a combination of the non-self-supporting layer with a supporting layer the optical properties of which are immaterial.

A non-self-supporting layer, typically consisting essentially of solid particles from 0.1 μm–5 μm (micrometer) may be sputter-coated or vacuum deposited; particles up to 44 μm in average size may be conventionally deposited; while films less than 0.5 mils (0.0005") thick, say from 10 μm to about 13 μm, may be formed by known means. A non-self-supporting intermediate layer less than 0.0005" thick may consist of only the particles which define the code, or such particles supported on a thin film of material, preferably a polymeric film.

The face of the upper layer of the standardized document carries the human-readable indiciae and comprises an upper lamina which provides a selectively reflective background, substantially fully light-reflective in the visible, and substantially transparent (light-permeable) in the infrared or ultraviolet regions. The electrical conductivity of the upper layer is irrelevant, as is that of the base layer, provided such conductivity, if present, does not interfere with operation of the device used to read the coded intermediate layer of the laminated card.

Though the principles upon which the interaction of the components of the laminated standardized document, are well known in optical physics, the choice of the components with a view to their desired interaction is unique.

SUMMARY OF THE INVENTION

A laminated standardized document of no value as a playing card in a game, is imprinted on an intermediate layer, with concealed, machine-scannable coding indicia, either as a single set of coding indicia (say, a fingerprint, bar code, or a photograph composed of a multiplicity of dots each no smaller than the width of a beam with which the photograph is to be read) readable from either of two generally axially opposed directions; or, as multiple coding indicia (plural sets of bar codes, say) readable from any arbitrary direction so long as the document is presented to the reader with its IR or UV-light permeable face directly facing the reader. Particular such documents are ID cards, bank and other credit cards, and the like. The coding indicia may also be imprinted along each margin of the intermediate layer, or, the entire surface of the intermediate layer.

The machine-scannable code is imprinted with a IR or UV-absorbing printing medium so that the code is read by the reader in the same direction as a human would read the human-visible information on the principal side of the document, referred to herein as the "face" of the document. In an ID card the upper face of the document typically carries a photograph of the owner of the card printed with a dyestuff which is permeable to human-invisible radiation.

If the code is imprinted unidirectionally, say in the direction of the longitudinal axis of the document, then the document will be read as long as a portion of the document carrying the imprinted code passes transversely (that is, not parallel to the direction in which lines of the indicia are marked on the document) over an electro-optical reading means which identifies the document and can read the coded information it conceals. The code read is then used for whatsoever purpose it was provided.

It is a specific object of this invention to provide a laminated document having (1) an upper lamina or top layer which is entirely selectively light-permeable to light in the IR or UV regions, but not in the visible region, and the upper face of the top layer is imprinted with human-visible indicia conveying human-readable information printed with a pigment-free non-aqueous printing medium chosen from non-aqueous inks and dyestuffs (2) a lower lamina or base layer which serves as a supporting layer for (3) an intermediate, selectively light-reflective coded layer which is sandwiched between the upper and lower laminae, so that the code on the intermediate coded layer, which may or may not be visible to the human eye, is readily machine-readable. The code is read by a device using light in a predetermined wavelength to which the upper lamina is permeable, and which predetermined wavelength is selectively reflected/absorbed by the intermediate layer and coding indiciae thereon, so as to provide sufficient contrast to be read by a "reader". The reader most preferably is an electro-optical reading means sensitive to light in the wavelength range above about 7000 Å Angstroms (700 nm) but below about $2.2\times10^5$ Å, preferably in the infra-red range from about 800–$10^4$ nm, more preferably 800–2000 nm (near infrared). The document may be read laterally, either substantially unidirectionally, from either end but face down; or, without regard for the document's face-downwards lateral orientation.

It is a specific object of this invention to provide a laminated label or other standardized document the upper (top) layer of which is made of non-fibrous material which is substantially reflective in the visible spectrum and is marked with visible indicia in black or colored inks, but the material and inks are both permeable to IR or UV light; the intermediate layer is light-reflective and substantially coextensive with the document. The intermediate layer has a code imprinted thereupon which absorbs light in a predetermined wavelength range, the intermediate layer being sandwiched between the upper layer and a base layer which supports the intermediate layer. The optical properties of the base layer are immaterial to the information-transmitting function of the code in the document.

BRIEF DESCRIPTION OF THE DRAWINGS

The foregoing and additional objects and advantages of the invention will best be understood by reference to the following detailed description, accompanied with schematic illustrations of preferred embodiments of the invention, in which illustrations like reference numerals refer to like elements, and in which.

DETAILED DESCRIPTION OF PREFERRED EMBODIMENTS

The coded document of this invention is coded underneath its surface with an arbitrarily chosen machine-readable human-invisible indiciae, because the code is physically, literally "covered up" with an opaque, or nearly opaque sheet. Typically, if it were not for the "cover sheet" or upper lamina the machine-readable code would also be clearly visible to the human eye. The upper surface or "face" of the coded document usually carries a legend, drawing or photograph, printed with non-aqueous ink or dyestuff which is meant to be read by the human eye ("human-visible"), on the same area (field) as the machine readable indicia, or on different areas.

Though it is most preferred to use a code imprinted in an ink which absorbs both in the visible and the IR region, the code may also be provided without using an ink, that is, inklessly. The code may be provided by depositing microscopic particles of powder, such as crystals from a solution of an inorganic salt such as barium sulfate, or a solution of an organic salt such as sodium acetate. The particles are chosen for their absorptivity of the wavelength of light used by the reader.

In another embodiment, a dispersion or solution of inorganic or organic particles used to produce the bar code may be chosen to fluoresce in the visible or infrared when illuminated by an appropriate UV light source, contrasting with the spaces and background.

In general, a clandestine bar code, namely one which cannot be read by the naked eye, may be textured into any surface which already bears visible indicia, for example, a garment label, a ticket to a ball game, stock certificates, legal documents, bank drafts, checks and bank notes. When the code is textured, it will be readable by either an infrared or ultraviolet detection system, that is, in a range outside the visible. When the surface to be coded is smooth, one has the option of providing either a textured bar code, or a code with an invisible dispersion of dye or microscopic powder.

In the particular instance of conveying printed information in a predetermined limited area, for example a printed page of text, the use of invisible solutions readable in the IR or UV regions may be used to increase the density of text several fold. For example, a laminated sheet of conventionally printed text, printed in ink which to the eye appears jet black, may be overlaid and bonded to a second sheet imprinted with an invisible solution which is readable in the infrared, and again overprinted with an invisible solution which is readable in the ultraviolet. Thus, the number of forms of text is limited only by the optical wavelength band width of the detectors, the band width of the exciting radiation, and the responsivity of the inks or solutions, whether absorbers or fluorescers. In some instances, the inks or solutions may not be overprinted one on top of the other, but within unprinted or blank spaces such as interlinearly in a page of conventional text.

Figure 1:
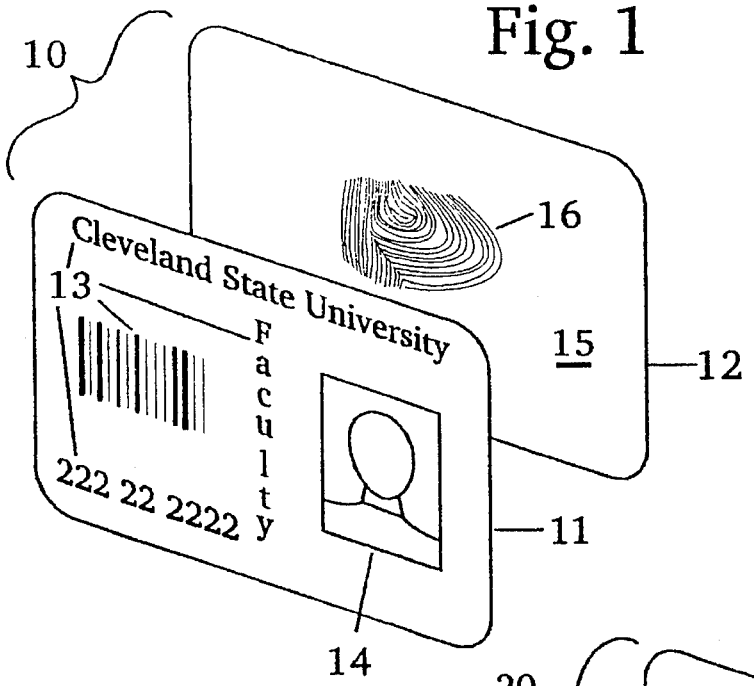
FIG. 1 is a schematic exploded representation of an ID card displaying conventional human-visible indiciae on the upper layer or face of the card, imprinted with IR-permeable ink, and showing a sputter-coated fingerprint, or one made by a person whose finger was first coated with ordinary human-visible and IR-absorbing India ink. The fingerprint is placed in the intermediate zone, against a reflective, preferably metallized surface, on the lower lamina or base layer. Only a single fingerprint is necessary since the reader will recognize the pattern irrespective of the orientation in which it is presented.
Figure 2:
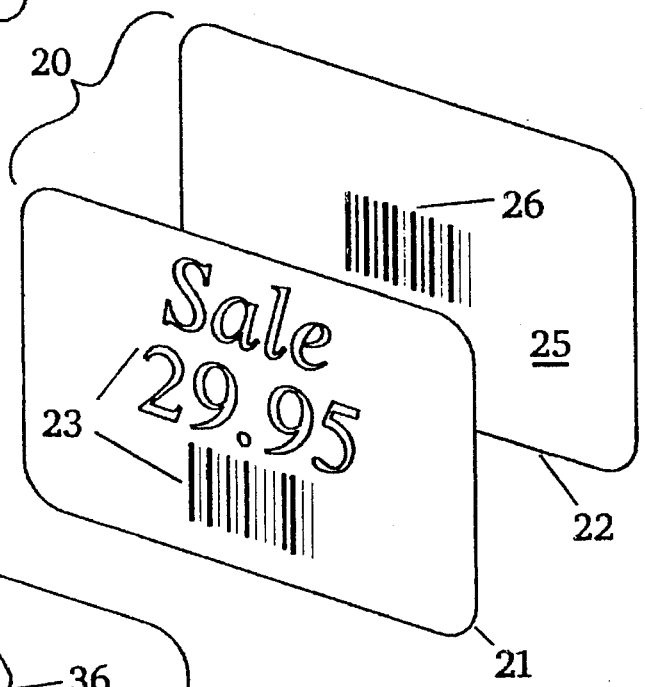
FIG. 2 is a diagrammatic exploded representation of a conventional label used on merchandise showing a human-visible and machine-readable first bar code, under the legend giving the price of the item on sale, both imprinted in substantially IR-permeable ink, except that the label is used as the upper lamina of a laminate in which a second bar code is imprinted on the lower lamina. Again, the second bar code is printed with conventional printing ink containing colloidal carbon, which ink is both human-visible and IR-absorbing, but because the second bar code is covered with the upper lamina, the second bar code is not human-visible. The second bar code gives data such as the price paid for the item by the seller, the source of the item, the day it was acquired by the seller, etc., none of which information is meant for the prospective purchaser.
Figure 3:
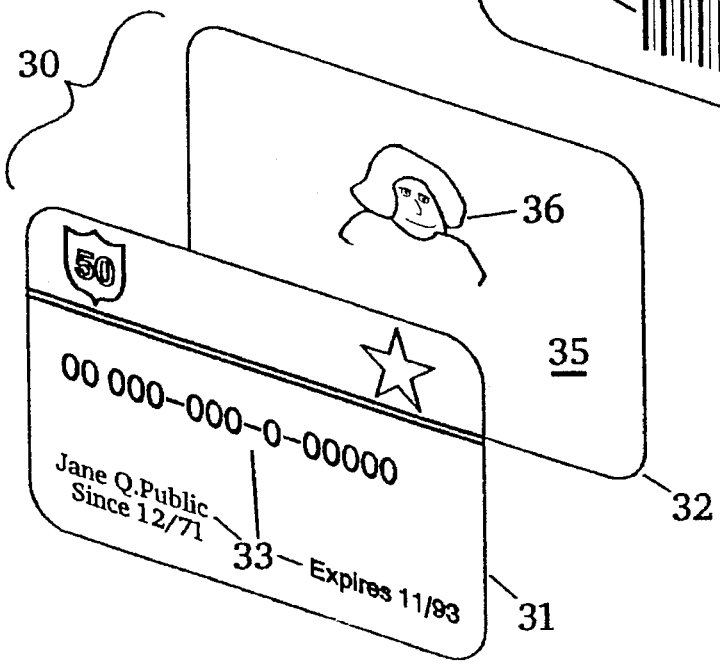
FIG. 3 is a schematic representation of a laminated plastic ID card which appears conventional except that it has a photographic likeness of the owner of the card imprinted on a thin sheet of machine-invisible synthetic resin which may be either non-self-supporting or self-supporting, and the thin sheet is bonded to a metallized surface on the lower lamina.

Referring to each of the documents illustrated in FIGS. 1–3, the upper lamina of each is made from material which reflects substantially all light in the visible spectrum, that is, the top layer is opaque or nearly opaque. For the specific embodiment of the invention described in detail below, a 905 nm IR beam, focussed to a spot size in the range from about 10 μm to about 200 μm is used. Such a beam directed upon an IR absorbing figure shows high contrast between the area occupied by the figure and the IR-reflecting background. Such a reflecting background is provided by a silver, aluminum or gold substrate any of which are highly reflecting at 905 nm. A broad area detector collects IR light reflected from and scattered by the reflecting background.

Referring, for example, to FIG. 1, there is shown an ID laminated card indicated generally by reference numeral 10, having an opaque upper lamina 11 and an opaque lower lamina 12. The face of the upper lamina 11 presents an opaque background against which is printed the desired human-visible indiciae 13. A photograph 14 is thermally bonded or adhesively secured to the face of the upper lamina 11. The photograph is developed with non-aqueous dyestuffs which are transparent to an IR beam, as are the indiciae 13 printed with inks which may be black or in color, and though these inks are transparent to the IR beam, they reflect substantially all light in the visible spectrum, so they are human-visible. By "substantially all light" we refer to at least about 80% of the light in the visible spectrum being reflected, the remaining 20% or less being transmitted.

The non-aqueous inks used may be formulated with direct dyestuffs, acid dyestuffs or basic dyestuffs, and combinations of one with another, depending upon the color to be used. Most preferred are the screen inks, so termed because they are used in screen printing, which are formulated with phthalocyanine, triarylmethane or azo-derived dyestuffs. Colors with such dyestuffs were formulated by Tech Ink Corp. of Akron, Ohio.

A coded intermediate layer 15 which is substantially coextensive with the document, preferably reflects substantially all the IR light (chosen for the reader) and this layer is provided with a fingerprint 16 of the owner of the card in IR-absorbing ink readable by the reader. When the laminae are bonded together, whether thermally, sonically or adhesively, and the document is held up and viewed against a bright light in the visible spectrum, there is no visible trace of the fingerprint 16 carried within the document. Only the indiciae carried on the face of the document can be read by a human because the fingerprint is covered. Viewed from the rear, only the indiciae (not shown) carried on the rear face of the lower lamina 12 can be read by a human. The optical properties of the lower lamina, whether it is permeable to light of any wavelength or not, is not material to its function herein if the ID card is to be read face-against the reader.

More specifically, Table I lists the various combinations of sources, appropriate detectors and the optical response which is monitored.

TABLE I

| Source | Detector | Optical response |
|---|---|---|
| IR | IR | Differential reflectivity or long wavelength fluorescence |
| Visible | IR | fluorescence |
| UV | Visible | fluorescence |
| UV | UV | reflectivity |

The difference in reflectivity read by the reading means determines whether the space read contains a bit. The reading means can only distinguish between reflective and non-reflective portions in the wavelength range visible to the reading means. The reading means therefore can use any wavelength range which is either in the IR or in the UV, the former being preferred.

The preferred document reader is of the type conventionally used and functions by scanning the IR laser over the surface of the document in a regular manner, analogous to the raster scan in a television tube. The response of the detector is recorded and displayed, for example, on an oscilloscope which is synchronized with the scanning motions, all of which is well known in the art. To operate with a low power IR beam the thickness of each lamina is in the range from about 1 mil to about 10 mils, the thicker the lamina, the more the undesirable back scattering of the IR radiation. Most preferred are laminae about 5 mils thick.

The upper lamina 11 which is overlaid on the lower lamina with the intermediate layer carrying the code therebetween, is preferably a pigmented synthetic resinous material which, without the pigment would be light permeable. When the pigment particles are smaller than the wavelength of the IR beam, the beam passes through what appears to be an opaque sheet. Though a white pigment is typically chosen, the pigment could be red, either providing enough back scattering in the visible to appear opaque also. Since permeability depends both on the particle size and their absorption function, it will be evident that small particles of the same size as the red ones will absorb too much of the infrared to be effective. Therefore pigments of any other color but white or red will not be suitable with a 905 nm IR beam. However, the surface of the upper lamina may be printed with an ink of arbitrary color provided the ink is IR-transparent.

Alternatively, a sheet of substantially crystalline, semicrystalline or amorphous polymer may be used, provided the substituent groups (if any) on each repeating unit, and the morphology of the polymer are such that it is opaque to human-visible light but permeable to the 905 nm IR beam. Though there is no known predictable manner for determining the correlation between polymer structure and permeability of light through that polymer structure, a suitable polymer may be found with routine trial and error. Commonly available poly(vinyl chloride) "shelf paper" used in kitchens, is suitable. Paper and other fibrous laminae are unsuitable because they scatter a much larger fraction of the IR light back to the detector, reducing the contrast.

Referring now to FIG. 2 there is shown a sales tag 20 to be laminated from upper and lower laminae 21 and 22 in a manner analogous to that described hereinabove. As before the upper lamina 21 carries on its face, a human-visible code 23. An IR-absorbing powder of an organic or inorganic material is deposited in a bar code 26 on the front surface 25. The powder used for the bar code is human-visible until it is covered by the upper lamina, when it is not visible against the surface of the lower lamina 22 but absorbs in the IR so as to be read by the reader. The intermediate layer is therefore only the powder.

Only a single bar code of multiple repetitively imprinted codes on the reflective upper surface of the lower lamina is shown. A single bar code, as shown, is readable in both directions by a stationary reader means, and readable in any orientation by a rotating reader means. For a fixed reader means, it is desirable that the bar code be readable in any orientation, and accordingly, multiple imprints of the bar code are provided in each of at least two directions, one perpendicular to the other, and preferably at least three if not four directions, the third and fourth directions being at 45° to the first two directions.

Referring now to FIG. 3, there is shown still another embodiment of an ID card 30 having upper and lower laminae 31 and 32 respectively and the upper lamina carries human-readable indiciae 33. A thin self-supporting sheet of a synthetic resinous material about 0.5 mil thick has imprinted on it a photograph which identifies the owner of the card. The photograph is preferably printed in "half-tone" form with individual dots about 0.002" (2 mils) in diameter, which is small enough to provide contrast when scanned by the laser which is absorbed by the dots. The thin sheet with the photograph on it is then bonded to the upper face of the lower lamina 22 which has been coated with a highly reflective gold foil.

The intermediate layer 35 is thus provided by a thin metal (aluminum or gold) or metallized film which reflects essentially all the light falling upon it. Such a metallized intermediate layer may be provided by any conventional technique for applying a thin film coating, for example, by vacuum deposition, sputtering or electrolytic deposition. By "thin film" we refer to a thickness which is sufficient to reflect substantially all infrared and visible light falling upon it. A preferred metallized layer is provided by sputtering or vacuum depositing aluminum, nickel, tin, copper and the like. Most preferred is gold because of its high reflectivity for IR radiation, lower initial optical transmissivity and its resistance to oxidation. The conductivity of the metallized layer is immaterial for the purpose of this invention, as the intermediate layer is substantially electrically insulated by the upper and lower laminae, and each of which is typically formed from insulating materials. An appropriate choice of a metal for the reflective intermediate layer may be made by reference to the teachings in the text "Physics of Thin Films" by J. L. Vossen Vol 9, Academic Press, New York (1977).

The photograph or any other writing, for example, coded information on a last will and testament, is preferably provided with colloidal carbon as before, requiring that the laminae be thick enough to provide opacity. If the code is provided in a "white" powder which is not visible against the normally reflective white surface of the base sheet, the writing is hidden from view even when the document is held up and viewed against a strong light. It will now be evident that any coded document, coded as disclosed herein, can make it essentially tamper-proof, avoiding costly legal battles.

To avoid using an infrared-permeable ink, the auxiliary layer of spreadable medium may be a thin layer of visible-light-scattering particles. Such particles are microspheres necessarily having a diameter in the range from about 0.5 μm to 0.6 μm (micrometers) commercially available under the Scotch-Lite brand from 3M Company. Such a thin layer of microspheres may be deposited from a suspension in a suitable liquid. The specific size range of the microspheres is required to scatter visible light which is reflected from the intermediate layer, and to allow infrared light having a wavelength in the range of about 0.8 μm or higher, to be transmitted so as to increase the contrast of the code read.

When so scattered, the visible light cannot be seen by the reading means in the reader, and the contrast between the reflected infrared light (substantially all of which is transmitted through the spreadable medium) and that absorbed by the bar code is increased.

It should be noted that Scotch-Lite microspheres are routinely used in the paper industry to reflect substantially all the visible light which falls upon paper containing them. In such a use (as a reflective material) the sizes of the microspheres are randomly scattered over a wide range with the specific intent of performing a mirror-function, that is, not transmitting any light, irrespective of its wavelength.

The high reflectivity of the intermediate layer provides from 50% to 90% contrast on the bar code pattern in the IR region, depending upon the reflectivity of the metallized layer and the effectiveness of absorption or scatter of the infrared permeable auxiliary layer, whether ink, paint, dye, or microspheres.

The components of the laminated card are preferably adhesively bonded together with an adhesive which is essentially permeable to infrared light. Such an adhesive is commonly available rubber cement, or the glue in a commercially available solid glue stick. Most preferred is an infrared transmitting epoxy resin such as Epon 828 from Shell Chemical. When the intermediate layer is supported on a thin sheet of thermoplastic synthetic resin, for example poly(vinyl chloride), the thin sheet may be thermally bonded to the base layer and to the upper layer dispensing with the use of an adhesive. In another embodiment, the rear surface of the top sheet and the front surface of the base sheet may each be coated with a thermally bondable resin which is substantially transparent to the wavelength absorbed by the indicia of the code.

It will now be evident that the best mode for producing a coded document which provides no clue that it is coded, will depend in large part upon the economics of manufacturing the document, particularly with respect to the imprinting of the code within it, and more particularly when the code is a textured code.

Having thus provided a general discussion, described the coded document in detail, and having illustrated specific embodiments with examples of the best mode of making and using it, it will be evident that the invention has provided an effective and economical solution to a difficult problem. It is therefore to be understood that no undue restrictions are to be imposed by reason of the specific embodiments illustrated and discussed, except as provided by the following claims.

We claim:

1. A laminated document comprising, an upper lamina or top layer essentially opaque to visible light, said top layer having an upper or front surface imprinted with human-visible indiciae with a pigment-free, non-aqueous printing medium which absorbs and reflects wavelengths in a range from 4000 Å to 7000 Å, said top layer and printing medium being permeable to a preselected wavelength in the range of infrared or ultraviolet regions;

a lower lamina or base layer having an upper reflective surface which reflects said preselected wavelength as a reflected wavelength through said top layer, and a lower surface;

machine-scannable coding indiciae concealed by said top layer from human view in an intermediate zone between said lower surface of said top layer and said upper surface of said base layer said machine-scannable coding indicia being fixedly imprinted in said zone with material which absorbs said preselected wavelength incident upon said coding indicia;

said human-visible indiciae being imprinted over an area overlapping said machine-scannable coding indicia;

whereby said coding indicia is read with a scanning means using said preselected wavelength, and sensitive to the contrast between signals from said coding indicia and said reflective surface.

2. The document of claim 1 wherein said document is an identification card, and said preselected wavelength is provided by an infrared beam.

3. The document of claim 2 wherein said coding indicia is a fingerprint and said upper lamina is imprinted with a pigment-free, non-aqueous ink.

4. The document of claim 2 wherein said coding indicia is a bar code and said upper lamina is imprinted with a pigment-free, non-aqueous ink.

5. The document of claim 1 wherein said coding indicia is a photographic likeness imprinted in dots having a diameter of at least 905 nm with a pigment-free, non-aqueous ink.

6. The document of claim 1 wherein said pigment-free, non-aqueous printing medium is an ink selected from the group consisting of direct dyestuffs, acid dyestuffs, basic dyestuffs, and combinations of one with another.

7. The document of claim 1 wherein said coding indicia is defined with an inkless material which absorbs in the infrared region.

8. The document of claim 6 wherein said inkless material is selected from the group consisting of microscopic particles of powder defining said indicia and an organic pigment each of which is visible to the human eye before said document is laminated.

9. A standardized document comprising an intermediate layer which is substantially light-reflective and substantially coextensive with said document, said intermediate layer having a machine-scannable code imprinted thereupon which absorbs light in the infrared region, said intermediate layer being sandwiched between an upper lamina imprinted with human-visible indiciae, and a base lamina, said upper lamina printed with a non-aqueous printing medium which absorbs in the visible wavelength but is substantially transparent to light in said infrared region, said ink is printed on said upper lamina of card stock which reflects substantially all light in the visible spectrum, and transmits rather than reflects substantially all infrared light used to read said code, and said human-visible indiciae is imprinted over an area overlapping said machine-scannable coding indicia, scannable with an infra-red scanning means which absorbs infrared light incident thereupon and reflects substantially all light not incident thereupon.

* * * * *